US011359380B2

(12) United States Patent
McGraw

(10) Patent No.: US 11,359,380 B2
(45) Date of Patent: Jun. 14, 2022

(54) REMOVABLE SPINDLE FOR BANISTER

(71) Applicant: ARME SOLUTIONS, LLC, Barberton, OH (US)

(72) Inventor: Ryan McGraw, Wadsworth, OH (US)

(73) Assignee: ARME Solutions, LLC, Barberton, OH (US)

( * ) Notice: Subject to any disclaimer, the term of this patent is extended or adjusted under 35 U.S.C. 154(b) by 26 days.

(21) Appl. No.: 16/987,785

(22) Filed: Aug. 7, 2020

(65) Prior Publication Data

US 2022/0042316 A1 Feb. 10, 2022

(51) Int. Cl.
*E04F 11/18* (2006.01)

(52) U.S. Cl.
CPC ... *E04F 11/1817* (2013.01); *E04F 2011/1819* (2013.01)

(58) Field of Classification Search
CPC ... E04F 11/18; E04F 11/1802; E04F 11/1808; E04F 11/181; E04F 11/1812; E04F 11/1817; E04F 11/1842; E04F 11/1844; E04F 11/1846; E04F 2011/1823; E04F 2011/1825; E04F 2011/1827
See application file for complete search history.

(56) References Cited

U.S. PATENT DOCUMENTS 2,840,349 A * 6/1958 Raymond ..... E04F 11/181 256/21
RE28,493 E * 7/1975 Weeden ..... E06B 3/9641 256/65.04
4,386,761 A * 6/1983 Kato ..... E04F 11/1842 256/59
7,971,412 B1 * 7/2011 Lim ..... E04F 11/1814 52/832
8,348,242 B2 * 1/2013 Rock ..... E04F 11/1817 256/22
8,424,850 B2 * 4/2013 Bennette ..... E04H 17/1447 256/10

(Continued)

FOREIGN PATENT DOCUMENTS

DE 3342668 A1 * 6/1985
DE 29713075 U1 * 9/1997 ..... E04F 11/1812

(Continued)

*Primary Examiner* — Jonathan P Masinick
(74) *Attorney, Agent, or Firm* — Emerson Thomson Bennett; Roger D. Emerson

(57) ABSTRACT

Provided in this disclosure is a selectively replaceable spindle for a banister. The spindle includes a generally longitudinal body having first and second ends for respectively engaging recesses on opposing surfaces of a handrail and a lower rail of a banister. A securement mechanism is attached to either of the first or second ends of the body, for releasably securing the respective end to the respective recess. The securement mechanism includes a spring-biased clip extending from the respective end of the body that is urged into contact with the respective recess. A lever is attached to the spring-biased clip for compressing an internal spring and enabling retraction of the spring-biased clip from the respective recess. The lever thus releases the secured one of the first or second ends of the generally longitudinal body from the respective one of the first or second recesses, thereby permitting removal of the spindle.

15 Claims, 8 Drawing Sheets

(56) References Cited

U.S. PATENT DOCUMENTS

| | | | | |
|---|---|---|---|---|
| 2010/0012910 | A1* | 1/2010 | Napier | E04F 11/1859<br>256/34 |
| 2013/0068906 | A1* | 3/2013 | Chung | E04F 11/1846<br>248/222.14 |
| 2013/0128591 | A1* | 5/2013 | Bennette | E04F 11/1817<br>256/65.02 |
| 2015/0327728 | A1* | 11/2015 | Aubain | A47K 3/003<br>4/576.1 |

FOREIGN PATENT DOCUMENTS

| | | | | |
|---|---|---|---|---|
| EP | 1338718 | A2 * | 8/2003 | E04F 11/181 |
| FR | 2048324 | A5 * | 3/1971 | |
| KR | 200410725 | Y1 * | 3/2006 | |
| KR | 20150091858 | A * | 8/2015 | |

* cited by examiner

REMOVABLE SPINDLE FOR BANISTER

BACKGROUND

A. Technical Field

This invention pertains to the field of banisters alongside stairways and balconies. In particular, the invention pertains to spindles used as the vertical component of a banister.

B. Description of Related Art

It is a well known and commonplace feature of homes and other buildings to provide a banister as a support structure next to a stairway, balcony, deck or other such elevated structure. A typical banister includes a handrail which is a horizontal component upon which persons can grip or rest their hands while going up and down stairways, or while walking next to a balcony, platform, or other elevated surface. A banister also includes a plurality of spindles which are vertical components having a top portion connected to the underside of the handrail. A banister can also include a lower rail which is a second horizontal component having a top side for connecting to a bottom portion of the spindle. The lower rail is then directly connected to a floor or to selected steps on a stairway. In some banister styles, the spindles are directly connected to the floor or to the selected steps of the stairway without using a lower rail.

Many banister styles are known, and can be made of wood, metal or other materials based on the architectural and aesthetic requirements of the stairway or balcony. Some banister styles include various decorative elements, including stylized members in addition to or instead of one or more spindles. However, banisters are commonly designed to be constructed and installed as permanent fixtures with no subsequent modification. Any subsequent modification would entail complete removal and disassembly of the banister. Upon performing any modifications, the banister would then be reassembled and reinstalled, which would be a laborious and expensive process.

SUMMARY

Provided in this disclosure is a selectively replaceable spindle for a banister. The present spindle includes a generally longitudinal spindle body having a first end for engaging a first recess on a surface of a handrail of a banister, and a second end for engaging a second recess on a surface of a lower rail of a banister, opposite from the handrail. A securement mechanism is attached to either the first end or the second end of the generally longitudinal spindle body, for releasably securing the respective end of the generally longitudinal spindle body to the respective one of the first or second recesses. The securement mechanism includes a spring-biased clip extending from the respective end of the generally longitudinal spindle body that is urged into contact with the respective recess. A lever is attached to the spring-biased clip for compressing an internal spring and enabling retraction of the spring-biased clip from the respective recess. The lever thus releases the secured one of the first or second ends of the generally longitudinal spindle body from the respective one of the first or second recesses, thereby permitting removal of the spindle.

The selectively replaceable spindle is designed to that the spindle body can include indicia formed on a surface of the body. The indicia can include a desired color scheme, a logo, a slogan, a message, a pattern, or decorative elements.

Additionally or alternatively, the spindle body can be formed to include any desired decorative shape extending between the first and second ends of the spindle. Further additionally or alternatively, the ends of the spindles can be modified to include a slot for receiving and retaining a light element between the spindle body and the respective recess. Still further additionally or alternatively, the spindle body can be formed of a translucent material and include one or more sources for providing an internally illuminated spindle. The spindle body can include an internal power supply or a plug for connecting to an external power supply, for providing illuminating power to the light source(s).

In addition to the spring-biased clip structure mentioned hereinabove, the securement mechanism can include other components such as a spring-biased tensioning structure for providing a load bearing spindle body. Such a tensioning structure can include screws affixed to one or bath of the first and second ends. The recesses can each include a nut for mating with a respective screw, for providing additional stability to the load bearing spindle body.

According to one aspect, the present invention can provide a banister with selectively replaceable spindles that can be switched out at will to provide a banister with a selection of temporary or permanent decorative options.

According to another aspect, the present invention can provide a banister with customized spindles that can be selectively replaced to accommodate holiday, event, seasonal, or other decorative options.

According to yet another aspect, the present invention can provide a banister that can generally be constructed and installed to enable subsequent modification without complete removal and disassembly of the banister.

According to still another aspect, the present invention can provide a banister that can be selectively modified without a laborious and expensive process.

Other benefits and advantages of this invention will become apparent to those skilled in the art it pertains upon reading and understanding of the following detailed specification.

BRIEF DESCRIPTION OF THE DRAWINGS

The disclosed removable spindle for a banister may take physical form in certain parts and arrangement of parts, embodiments of which will be described in detail in this specification and illustrated in the accompanying drawings which form a part hereof and wherein.

DETAILED DESCRIPTION

Figure 1:
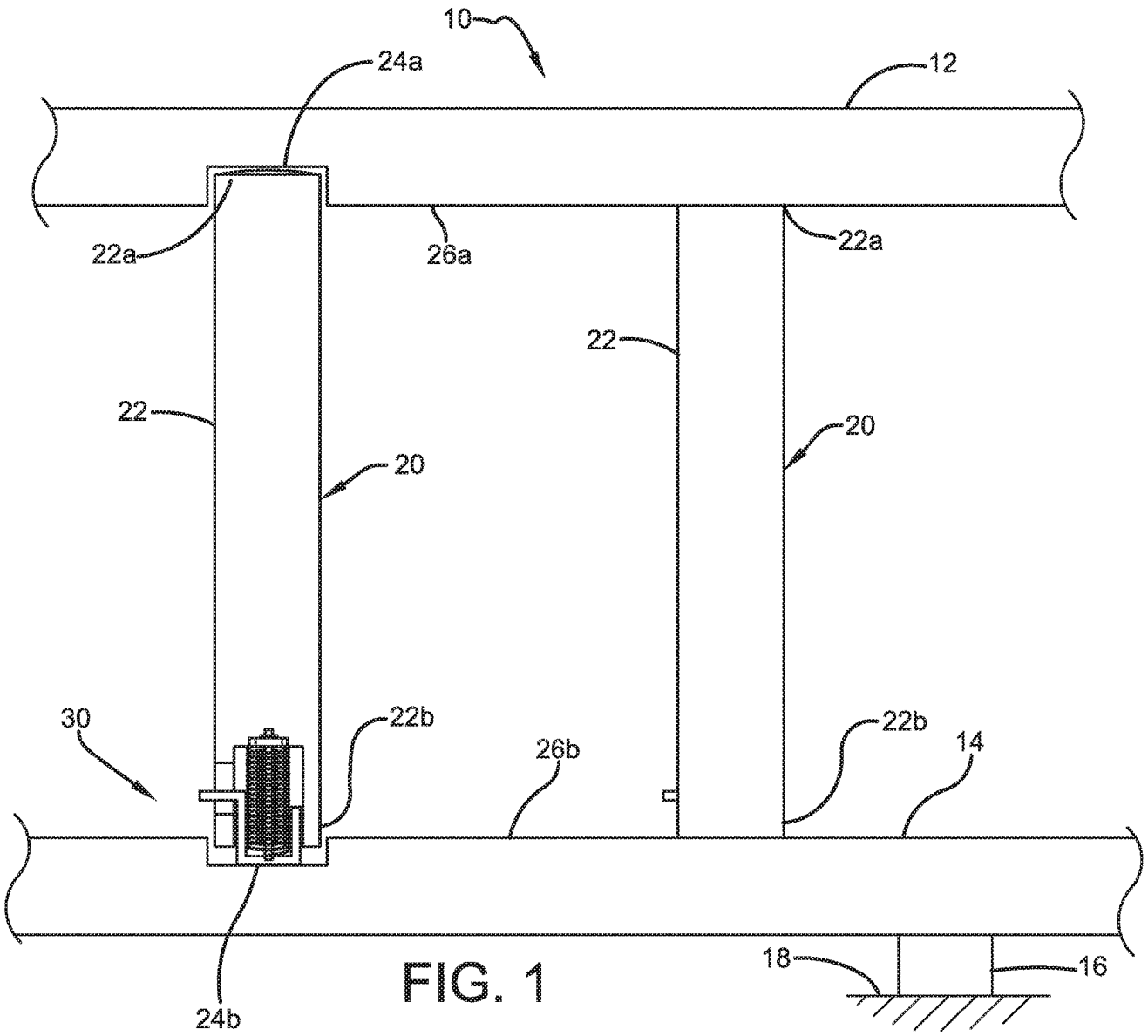
FIG. 1 is a partial side sectional view revealing the construction of a removable spindle for a banister in accordance with an exemplary embodiment of the present invention.

Referring now to the drawings wherein the showings are for purposes of illustrating embodiments of the article only and not for purposes of limiting the same, and wherein like reference numerals are understood to refer to like components:

As depicted in FIG. 1, a banister 10 is generally disclosed including a handrail 12 and a lower rail 14 positioned opposite and generally parallel to the handrail 12. The lower rail 14 includes a plurality of bases 16 mounted on its underside which connect and support the banister 10 to a surface 18 such as a floor or a stairway, as understood in the art. A plurality of spindles 20 are provided, each spanning the distance between the handrail 12 and the lower rail 14, and secured to the handrail 12 and lower rail 14 (typically about 36 inches). Though the figure only depicts two spindles 20, with the first spindle 20 shown in a sectional view, it is to be appreciated that a banister 10 having a handrail 12 and a lower rail 14 of any desired length can be contemplated, thereby including an unlimited desired number of spindles 20, all without departing from the invention.

As shown in FIG. 1 and throughout the drawings, the spindle 20 is a selectively replaceable spindle 20 for a banister 10. The spindle 20 includes a generally longitudinal spindle body 22 having a first end 22*a* and a second end 22*b*. The first end 22*a* is configured for engaging a first attachment portion 24*a* on a surface 26*a* of the handrail 12 of the banister 10, where the surface 26*a* is preferably an underside of the handrail, underneath the portion contacted by the hand of a user. The second end 22*b* of the spindle body 22 is configured for engaging a second attachment portion 24*b*, on an opposite surface 26*b* from the handrail 12. In the preferred embodiment, the opposite surface 26*b* from the handrail 12 is a top surface of the lower rail 14 including the second attachment portion 24*b* so that the spindle 20 removably extends between the handrail and the lower rail. However, in an alternate embodiment, the opposite surface 26*b* can be the surface 18 such as a floor or stairway, with the second attachment portion 24*b* formed directly thereupon, for implementations in which the spindles 20 connect directly to the floor.

As also shown in FIG. 1 and throughout the drawings, in the preferred embodiment, one or more of the attachment portions 24*a*, 24*b* are recesses formed respectively into the surface 26*a* of the handrail 12 and the opposite surface 26*b* from the handrail 12, for respectively receiving the first and second ends 22*a*, 22*b*. The recesses 24*a*, 24*b* can be cylindrical bores or concave spherical indentations in the surfaces 26*a*, 26*b*, or any other suitable shape for receiving the first and second ends 22*a*, 22*b*. Accordingly, the first and second ends 22*a*, 22*b* can be convex in shape or any other suitable shape to form a stable, secure mating relationship with the recesses 24*a*, 24*b*. In an alternative embodiment, the attachment portions 24*a*, 24*b* can be a type of projection formed onto the surfaces 26*a*, 26*b*, to mate with a suitable concavity formed on the first and second ends 22*a*, 22*b*, all without departing from the invention.

Figure 2:
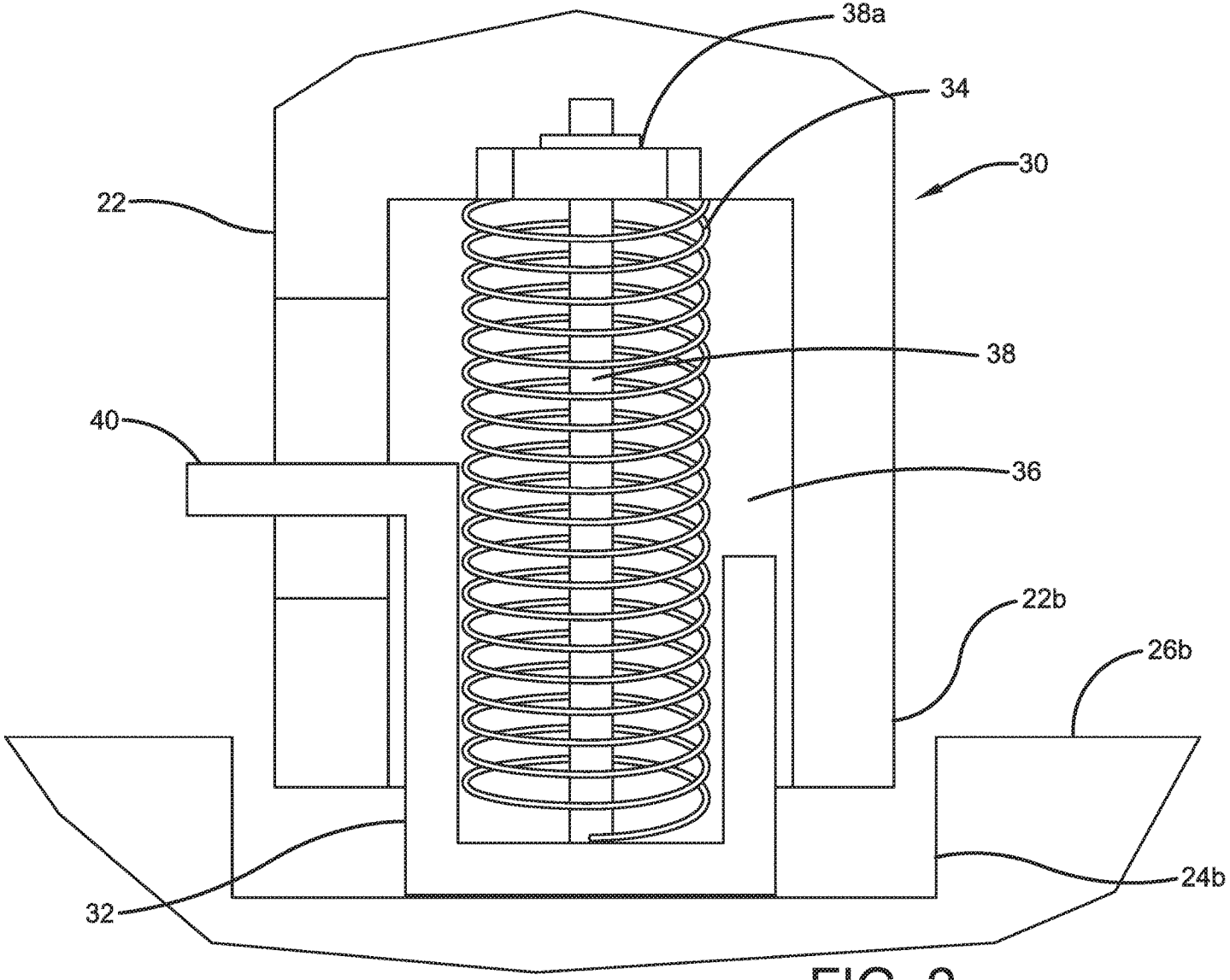
FIG. 2 is a zoomed in side sectional view of an engagement structure for the removable spindle for a banister of FIG. 1 in accordance with an exemplary embodiment of the present invention.

As shown in FIGS. 1 and 2, a securement mechanism 30 is provided for releasably securing one of the ends 22*a*, 22*b* of the generally longitudinal spindle body 22 to one of the first or second attachment portions 24*a*, 24*b*. It should be appreciated that the securement mechanism 30 can be attached to the second end 22*b*, on the bottom of the spindle body 22, and then engage the second attachment portion or recess 24*b* on the lower rail 14 or the surface 18. Alternatively, the securement mechanism 30 can be attached to the first end 22*a*, on the top of the spindle body 22, and then engage the first attachment portion or recess 24*a* on the underside of the handrail 12, all without departing from the invention.

As specifically indicated in FIG. 2, the securement mechanism 30 comprises a spring-biased clip 32 extending outwardly from the respective end 22*b* of the generally longitudinal spindle body 22. The clip 32 cooperates with an internal spring 34 that is biased to urge the clip 32 into contact with the recess 24*b*. The clip 32 is preferably retained in a cavity 34 formed in the end 22*b* of the spindle body 22. The clip 32 is connected to a member which can be a threaded shaft 38 secured to a tee-nut 38*a* set into the top of the cavity 34. The shaft 38 limits the range of movement of the clip 32 and retains it onto the end 22*b* of the spindle body 22 when not in engaging contact with the recess 24*b*. Alternatively, the clip 32 can be hidden and pops out when used, when the spindle 20 is in place. The clip 32 can be hidden within the spindle 20 or other decorative design within or on the spindle 20.

With further reference to FIG. 2, an actuating member is in mechanical engagement with the securement mechanism 30 for releasing the secured end 22*b* of the generally longitudinal spindle body 22 from the respective attachment portion or recess 24*b*. The actuating member is preferably a lever 40 attached to the spring-biased clip 32 for compressing the internal spring 34 and enabling retraction of the spring-biased clip 32 from the respective recess 24*b*, thereby permitting removal of the spindle 20. The lever 40 is formed so that it can be gripped with the fingers of a user and manually retracted by drawing it upward, away from the recess 24*b*, in order to compress the internal spring 34. The spindle body 22 is formed with a groove 42 through which the lever 40 protrudes, to extend beyond the surface of the spindle body 22 and thereby enable the lever 40 to be manually gripped.

In another aspect of the present invention, the securement mechanism and the actuating member can alternatively be formed as a single unitary component. A cap can be provided including the groove 42 and cavity 34 where the cap retains the shaft 38, which in turn retains the clip 32, with the lever 42 projecting through the groove 42. The cap thus forms a single unit that can be attached to the end 24*b* of the spindle body 22. Many other variations of the securement mechanism and the actuating member could alternatively be contemplated without departing from the present invention.

Figure 3B:
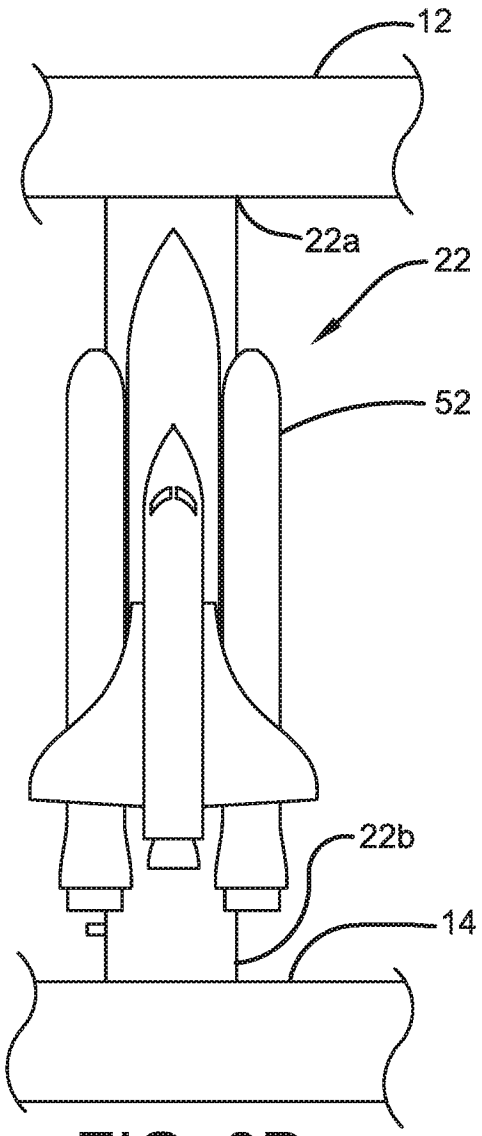
FIGS. 3A and 3B are alternate embodiments of the removable spindle for a banister including decorative features that can be optionally incorporated in accordance with the present invention.
Figure 3A:
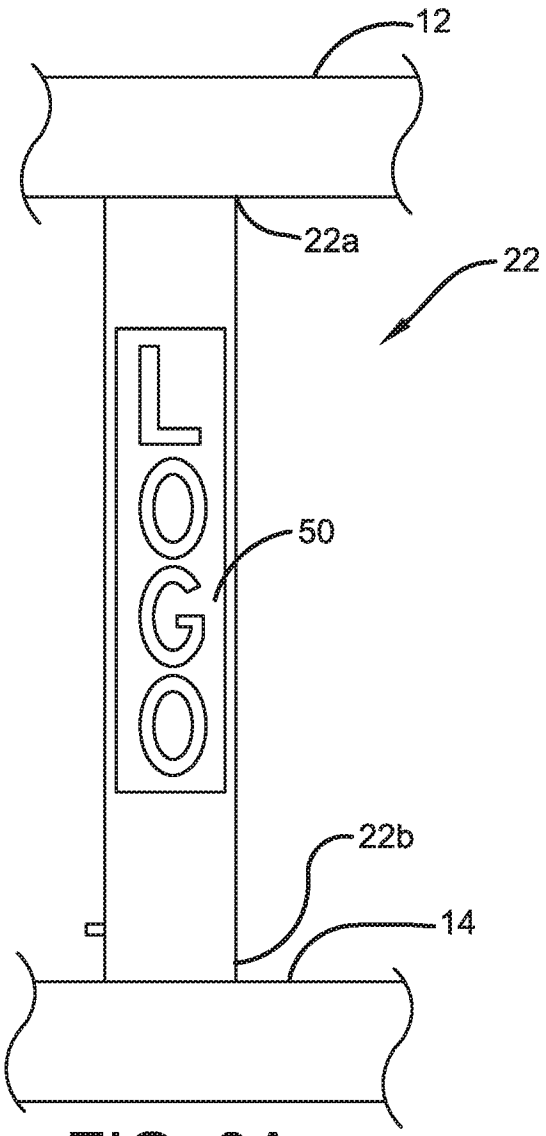

As shown in FIG. 3A, the generally longitudinal spindle body 22 can include indicia 50 formed on an exterior surface of the spindle 20. The indicia 50 can include any selected predetermined color scheme. For example, the color scheme can be selected to correspond to a holiday or seasonal motif, such as red and green for Christmas, and any other colors alone or in combination with other colors to indicate a commonly associated holiday, season, or event. The color scheme can also include the colors of a sports franchise. Any other suitable colors could be selected. The indicia 50 can also include a logo, a slogan, or a message associated with the holiday, season, sports team, or any other desired element. The indicia 50 can also include a pattern or any other decorative elements. The indicia 50 can be used to advertise a product. The spindles 20 with indicia 50 can be selectively replaced with any other spindles 20 having different indicia 50, in accordance with any desired change on the part of the user. Further, any combinations of spindles 20 having different indicia 50 could also be implemented, all without departing from the invention.

As indicated in FIG. 3B, the generally longitudinal spindle body 22 can be formed in a predetermined decorative shape 52 extending between the first and second ends 22*a*, 22*b*. The decorative shape 52 could be formed into the spindle body 22 or can include one or more elements that are affixed to the spindle body 22. The shape 52 can be any desired shape such as a space ship (as shown) or alternatively a famous building, sporting goods such as a baseball bat or a golf club, seasonal elements such as a snowman, other elongated shapes such as a rifle, or architectural elements such as a Greek pillar, or any other designs. The decorative shape 52 can be molded of plastic or otherwise formed by any other suitable techniques as are known in the art. The predetermined decorative shape 52 can be formed to act as the lever 40 attached to the spring 34 at the bottom or top of the spindle 20.

Figure 4C:
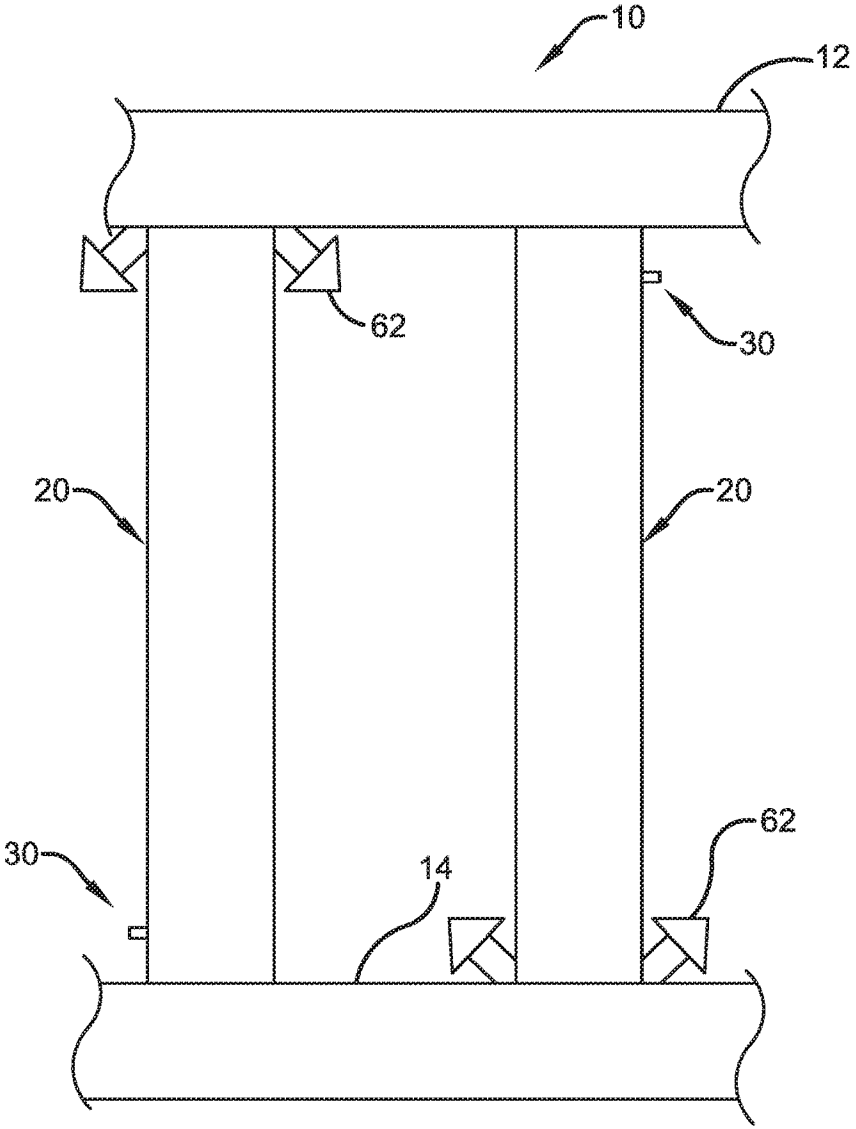
FIGS. 4A, 4B, and 4C are respective side, side perspective, and complete side assembled views of the removable spindle, alone and in a banister, and including light elements that can be optionally incorporated in accordance with an exemplary embodiment of the present invention.
Figure 4B:
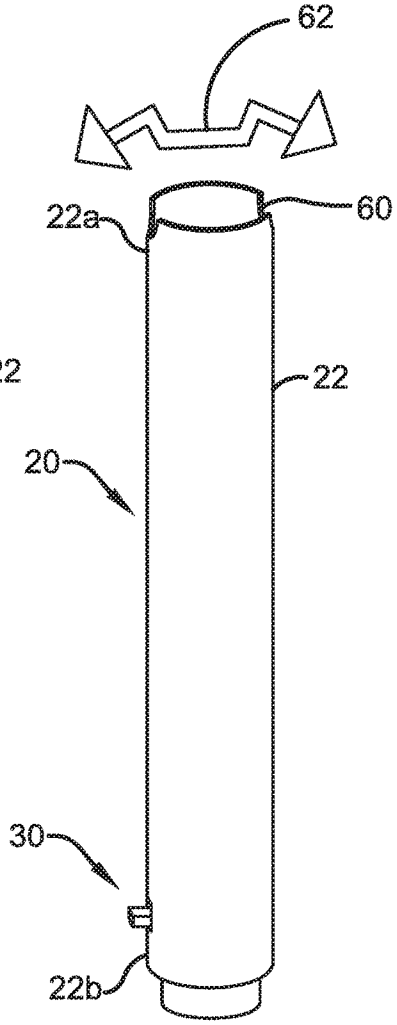
Figure 4A:
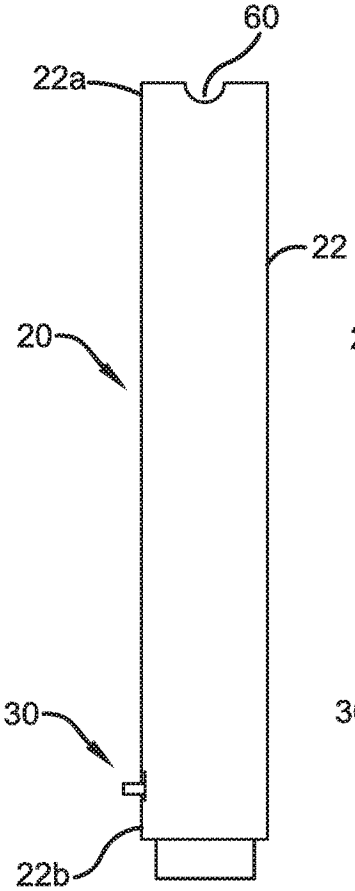

An alternate lighting embodiment of the spindle 20 is shown in FIGS, 4A, 4B, and 4C. The first end 22*a* of the spindle body 22, opposite the securement mechanism 30, can be modified to include a slot 60 for receiving and retaining a light element 62. The light element 62 is securely retained within the slot 60 between the generally longitudinal spindle body 22 and the recess 24*a* or other respective attachment portion when the spindle 20 is assembled to the handrail 12. As shown in FIG. 4C, the spindle 20 can be formed and placed so the securement mechanism is at either the first end 22*a* or the second end 22*b* and the slot 60 is formed on the respective second end 22*b* or first end 22*a* opposite the securement mechanism 30, for retaining the light element 62 between the spindle body 22 and the respective recess 22*a*, 22*b*, so that the light element 62 is at either the top of the bottom, engaging the handrail 12 or the lower rail 14.

The light elements 62 can be powered multiple different ways. In one optional aspect, for an outdoor embodiment, the handrail 12 can have a solar-powered element that is connected to the light elements 62. In a second optional aspect, a solar component can include a cap that sits atop a rail post and charges the lights. Additionally, for indoor/outdoor use, each light element 62 can be battery powered with each light having an individual switch or button to turn off each light individually. This enables control of light output cast onto the deck, stairs, railing, spindles, etc. The light elements 62 can also be controlled remotely for easy on/off capability with the option of multiple colors, such as green and red rotating every other spindle for an optional Christmas motif. The light elements 62 can also be powered via a plug with an option of a single color or multiple colors. The lighting elements 92 can be individually power via solar, remote, or any other on/off option. Each light can have an individual power button or switch to turn on and off.

Figures 5A, 5B:
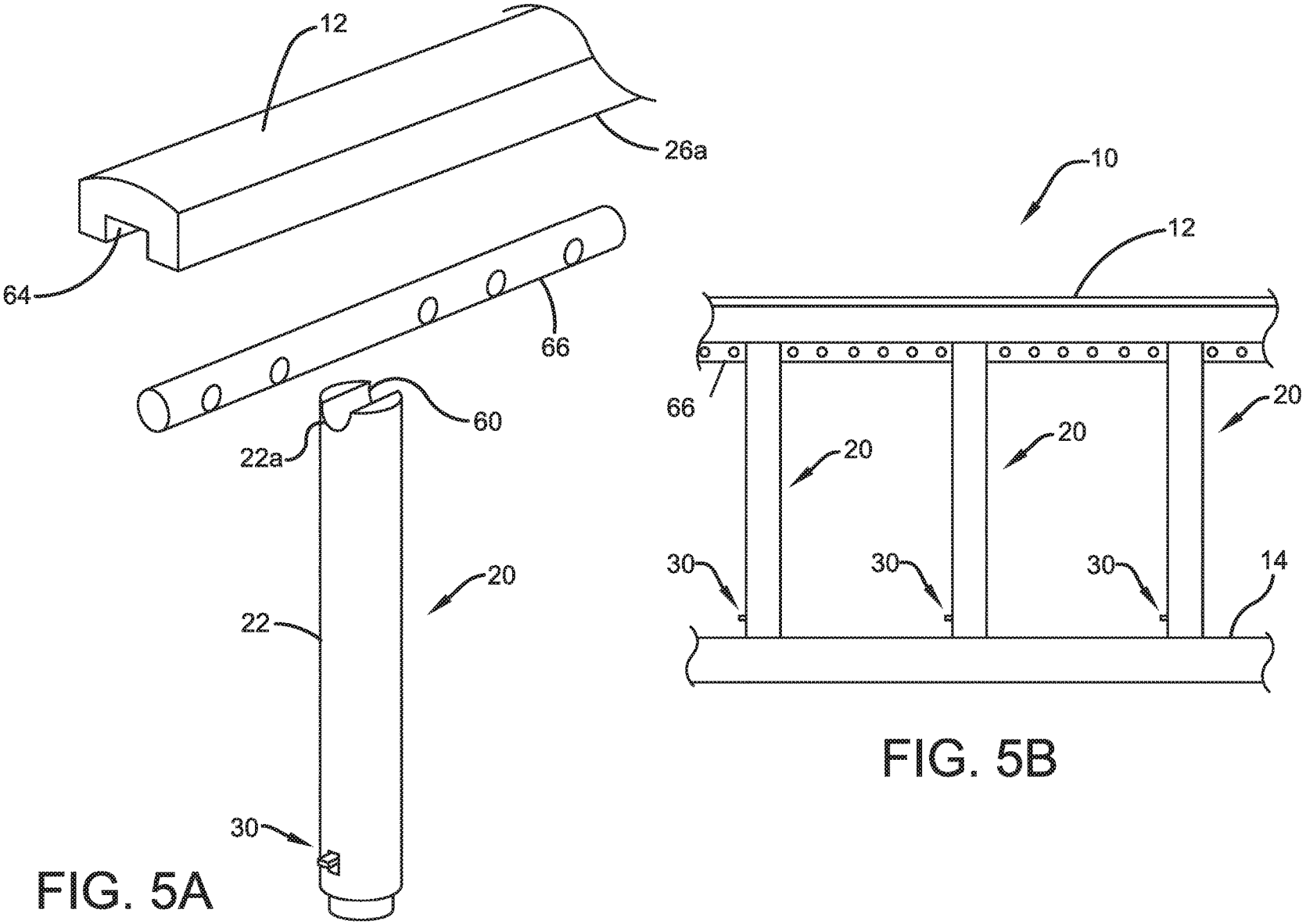
FIGS. 5A and 5B are respective exploded and side views of the removable spindle, alone and in a banister, and including light elements that can be optionally incorporated in accordance with an exemplary embodiment of the present invention.

A further alternate lighting embodiment of the spindle 20 is shown in FIGS. 5A and 5B. A second groove 64 can be formed in the underside surface 26*a* to cooperate with the groove 60 on the end 22*a* of the spindle body 22. In this manner, the spindles 20 can support and retain a strip lighting element 66 between the spindle body 22 and the respective recess 22*a*, 22*b*, so that the light element 62 is at either the top or the bottom, engaging the handrail 12 or the lower rail 14. In this manner, the alternate lighting embodiments can provide lighting to a banister 10.

Figure 6C:
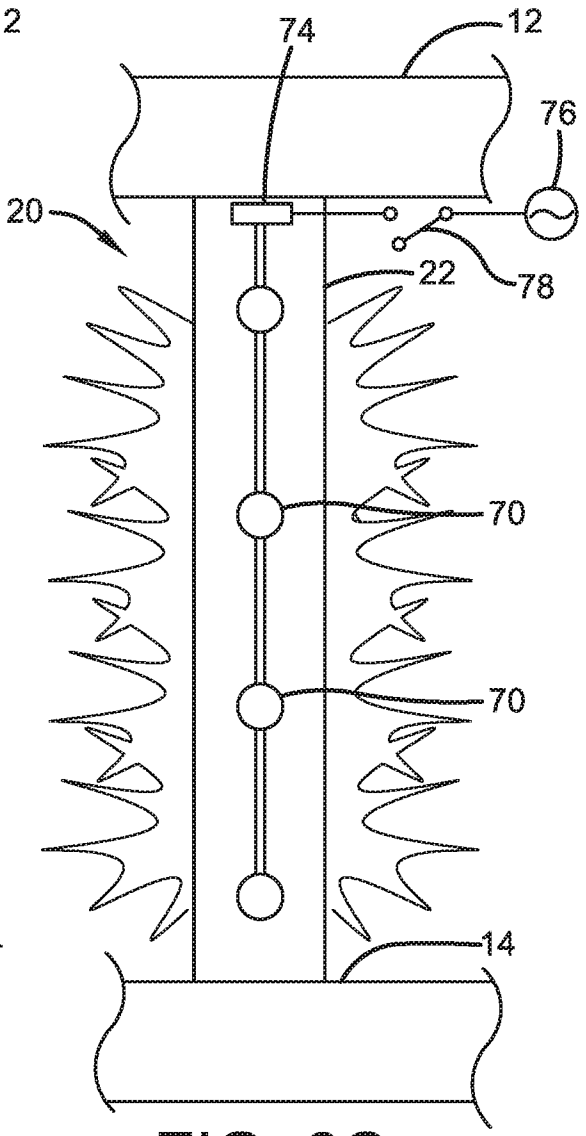
FIGS. 6A, 6B, and 6C are respective side and side sectional the removable spindle with a banister including internal light elements in accordance with an exemplary embodiment of the present invention.
Figure 6B:
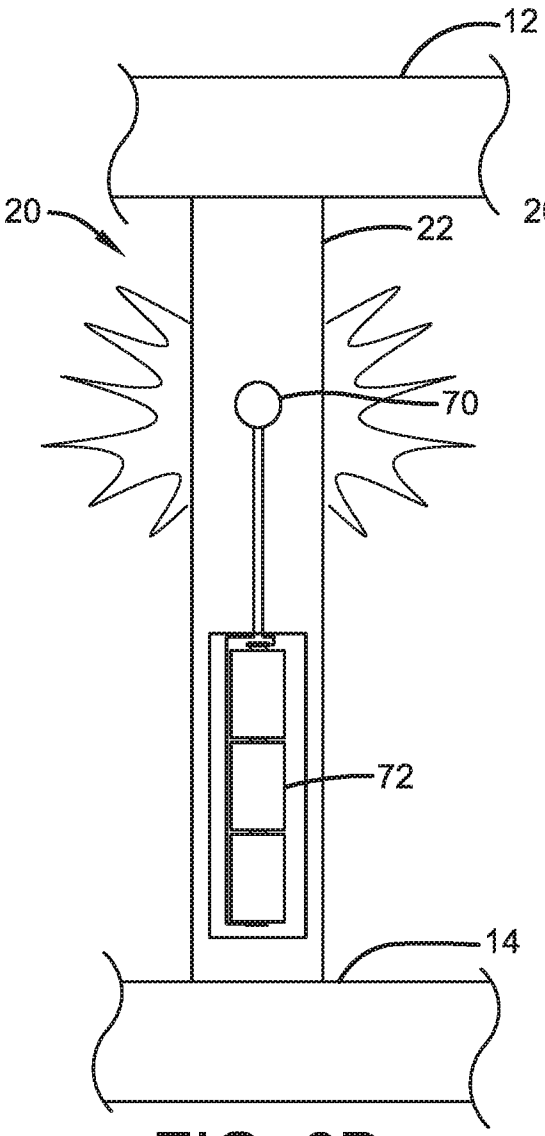
Figure 6A:
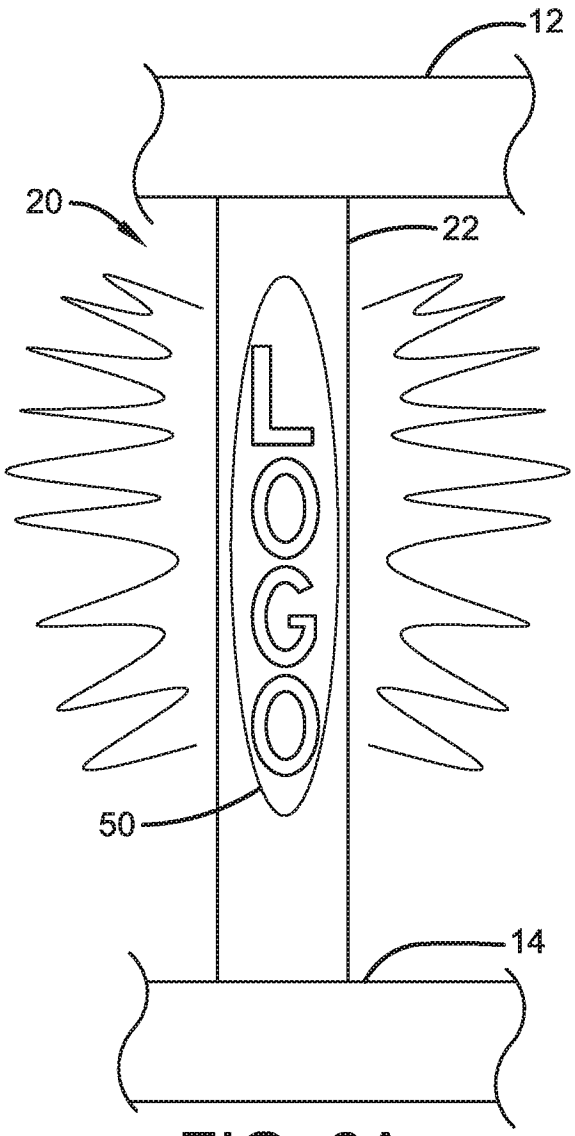

A further alternate lighting embodiment of the spindle 20 is shown in FIGS. 6A, 6B, and 6C in which the generally longitudinal spindle body 22 is formed of a translucent material that allows light to shine through from the interior of the spindle body 22. The spindle body 22 receives and retains one or more light sources 70 for providing an internally illuminated spindle 20. As with the embodiments of FIGS. 3A and 3B discussed hereinabove, the spindle body 22 can include indicia 50 including a color scheme, a logo, etc. that is illuminated from within. The internally illuminated spindle 20 can alternatively be in the form of a predetermined decorative shape 52 that is also illuminated from within.

As especially shown in FIGS. 6B and 6C, the internally illuminated spindle 20 can be powered by an internal power supply such as a row of batteries 72 that are connected to the light source 70. Alternatively, internally illuminated spindle 20 can include a plug 74 for connecting to a receptacle of an external power supply such as AC home utility power 76, which can be turned on and off with a switch 78. In this manner, the power supplies 72, 76 provide illuminating power to the light sources 70.

Figure 7:
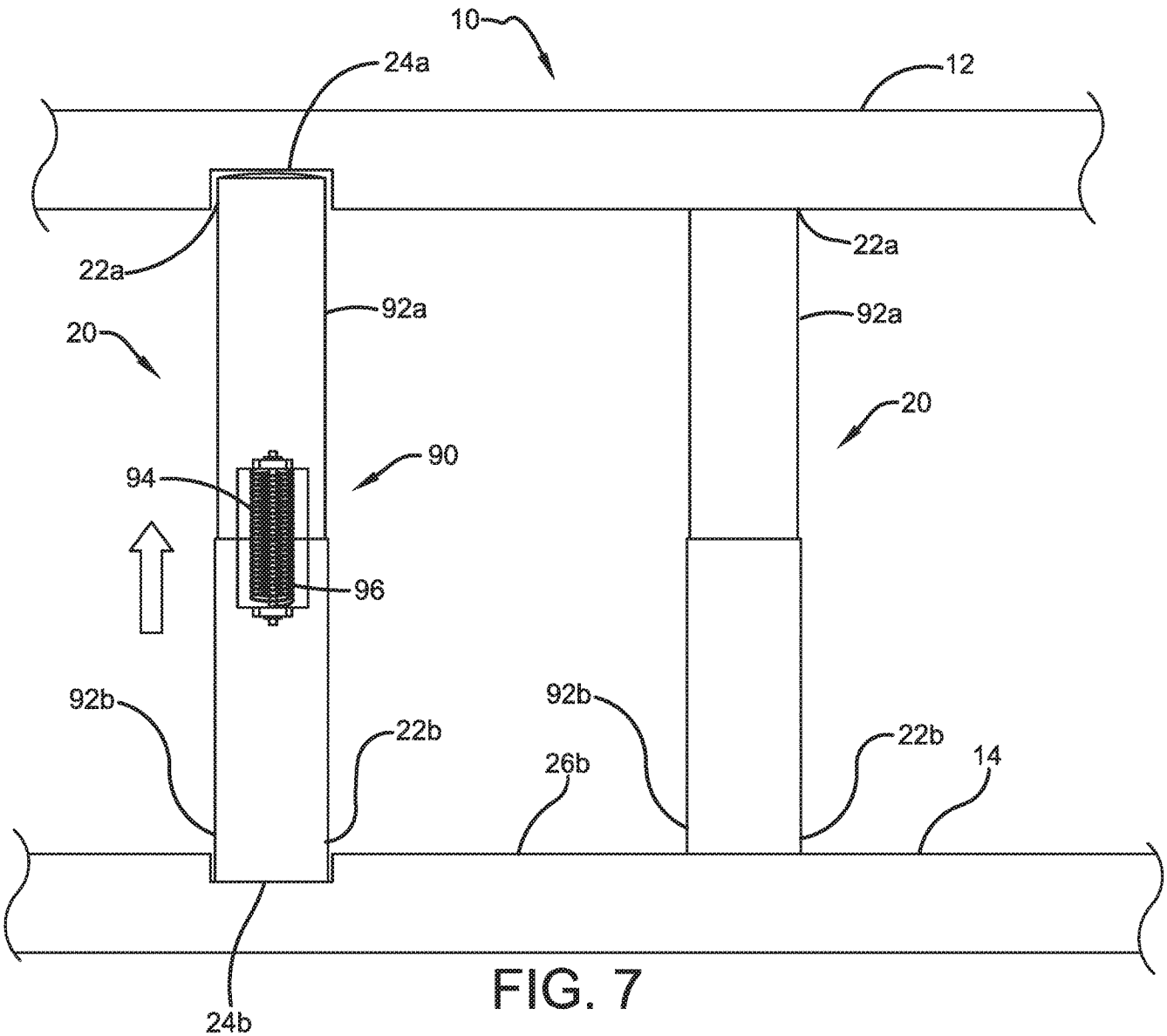
FIG. 7 is a partial side sectional view revealing the construction of a removable spindle for a banister including an alternate embodiment of an engagement structure in accordance with the present invention.

In the above embodiments, the replaceable spindles 20 can include some of the spindles 20 on a banister 10, while other solid piece spindles can be provided for mechanical load bearing strength at key structural areas. In the embodiments shown in FIGS. 7 and 8, it is contemplated that a selectively replaceable spindle 20 can be provided as a structural member that provides necessary mechanical stability and strength to bear the loads normally placed on a banister 10. Such a selectively replaceable spindle 20 can include an alternative securement mechanism that includes a spring-biased tensioning structure 90 for providing a greater load bearing capacity to the generally longitudinal spindle body 22. Such a tensioning structure 90 can be similar to the type used by adjustable shower rods and curtain rods, including a two-piece body 92*a*, 92*b* with an internal spring 94 and an internal shaft 96. Compression of the two-piece body 92*a*, 92*b* compresses the spring 94 and allows removal and replacement of the spindle 20. The two-piece body 92*a*, 92*b* can be rotationally tightened to increase the force of the spindle body 22 against the recesses 24*a*, 24*b*, thereby providing greater mechanical strength.

Figure 8:
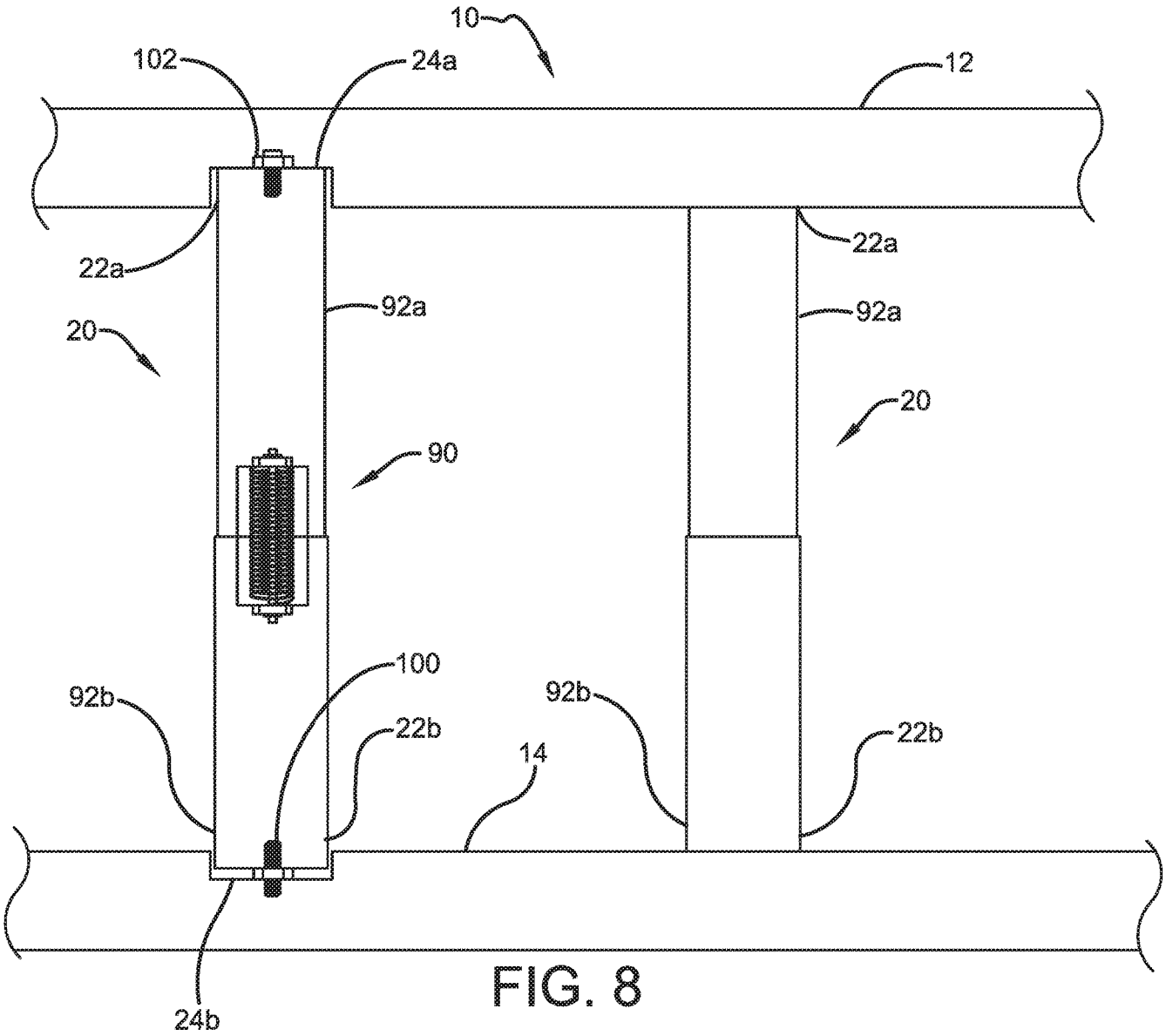
FIG. 8 is a partial side sectional view revealing the construction of a removable spindle for a banister including a further alternate embodiment of an engagement structure in accordance with the present invention.

As shown in FIG. 8, further additional strength can be imparted to the two-piece body 92*a*, 92*b* by affixing screws 100 to the respective ends 22*a*, 22*b* of the spindle body 22. A tee-nut 102 or suitable structure can be inserted into the recesses 24*a*, 24*b* for mating with the respective screws 100. These can secured by the rotation of the two-piece body 92*a*, 92*b* during insertion, for providing additional stability to the load bearing structure of the generally longitudinal spindle body 22, which can improve the mechanical strength of the banister 10.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

1. A selectively replaceable spindle for a banister, comprising:

a generally longitudinal spindle body having a first end for engaging a first attachment portion on a surface of a handrail of a banister, and a second end for engaging a second attachment portion, on an opposite surface from the handrail;

a securement mechanism for releasably securing one of the first or second ends of the generally longitudinal spindle body to one of the first or second attachment portions; and an actuating member in mechanical engagement with the securement mechanism for releasing the secured one of the first or second ends of the generally longitudinal spindle body from the respective one of the first or second attachment portions.

2. The selectively replaceable spindle of claim 1, wherein the securement mechanism is attached to one of the first end or the second end of the generally longitudinal spindle body.

3. The selectively replaceable spindle of claim 2, wherein the securement mechanism comprises a spring-biased clip extending from the respective end of the generally longitudinal spindle body that is urged into contact with the respective attachment portion.

4. The selectively replaceable spindle of claim 3, wherein the actuating member is a lever attached to the spring-biased clip for compressing an internal spring and enabling retraction of the spring-biased clip from the respective attachment portion, thereby permitting removal of the spindle.

5. The selectively replaceable spindle of claim 1, wherein the opposite surface from the handrail comprises a surface of a lower rail including the second attachment portion so that the spindle removably extends between the handrail and the lower rail.

6. The selectively replaceable spindle of claim 1, wherein at least one of the attachment portions are recesses formed respectively into the surface of the handrail and the opposite surface from the handrail, for respectively receiving the first and second ends.

7. The selectively replaceable spindle of claim 1, wherein the generally longitudinal spindle body comprises indicia formed on a surface having at least one of a predetermined color scheme, a logo, a slogan, a message, a pattern, or decorative elements.

8. The selectively replaceable spindle of claim 1, wherein the generally longitudinal spindle body comprises a predetermined decorative shape extending between the first and second ends.

9. The selectively replaceable spindle of claim 1, wherein the first end or the second end opposite the securement mechanism comprises a slot for receiving and retaining a light element between the generally longitudinal spindle body and the respective attachment portion.

10. The selectively replaceable spindle of claim 1, wherein the generally longitudinal spin body is formed of a translucent material and includes at least one light source for providing an internally illuminated spindle.

11. The selectively replaceable spindle of claim 10, wherein the generally longitudinal spindle body comprises one of an internal power supply or a plug for connecting to an external power supply, for providing illuminating power to the at least one light source.

12. The selectively replaceable spindle of claim 1, wherein the securement mechanism comprises a spring-biased tensioning structure for providing a load bearing generally longitudinal spindle body.

13. The selectively replaceable spindle of claim 12, further comprising at least one screw affixed to at least one of the first or second ends, and wherein a respective at least one attachment portion comprises a nut for mating with the at least one screw, for providing additional stability to the load bearing generally longitudinal spindle body.

14. A selectively replaceable spindle for a banister, comprising:

a generally longitudinal body having a first end for engaging a first recess on a surface of a handrail of a banister, and a second end for engaging a second recess on a surface of a lower rail of a banister, opposite from the handrail;

a securement mechanism, attached to one of the first end or the second end of the generally longitudinal body, for releasably securing the respective end of the generally longitudinal body to the respective one of the first or second recesses, wherein the securement mechanism comprises a spring-biased clip extending from the respective end of the generally longitudinal body that is urged into contact with the respective recess; and a lever attached to the spring-biased clip for compressing an internal spring and enabling retraction of the spring-biased clip from the respective recess for releasing the secured one of the first or second ends of the generally longitudinal body from the respective one of the first or second recesses, thereby permitting removal of the spindle.

15. A banister, comprising:

a handrail;

a lower rail, positioned opposite and generally parallel to the handrail, and secured to a surface;

a plurality of spindles, each spanning between the handrail and the lower rail, and secured to the handrail and lower rail, each of the plurality of spindles comprising:

a generally longitudinal body having a first end for engaging a first recess on a surface of the handrail, and a second end for engaging a second recess on an opposing surface of the lower rail, opposite from the handrail;

a securement mechanism, attached to one of the first end or the second end of the generally longitudinal body, for releasably securing the respective end of the generally longitudinal body to the respective one of the first or second recesses, wherein the securement mechanism comprises a spring-biased clip extending from the respective end of the generally longitudinal body that is urged into contact with the respective recess; and a lever attached to the spring-biased clip for compressing an internal spring and enabling retraction of the spring-biased clip from the respective recess for releasing the secured one of the first or second ends of the generally longitudinal body from the respective one of the first or second recesses, thereby permitting removal of the spindle.

* * * * *